US005482443A

United States Patent [19]

Bez

[11] Patent Number: 5,482,443

[45] Date of Patent: Jan. 9, 1996

[54] MULTISTAGE VACUUM PUMP

[75] Inventor: Eckhard Bez, North Chelmsford, Mass.

[73] Assignees: Commonwealth Scientific and Industrial Research Organization, Richmond, Australia; Fuji Seiki Inc., Yokohama, Japan

[21] Appl. No.: 116,609

[22] Filed: Sep. 7, 1993

Related U.S. Application Data

[63] Continuation-in-part of Ser. No. 993,860, Dec. 21, 1992, abandoned.

[51] Int. Cl.[6] ..... F04B 25/02; F04B 3/00

[52] U.S. Cl. ..... 417/266; 417/267; 417/491

[58] Field of Search ..... 417/266, 267, 417/536, 570, 491, 534

[56] References Cited

U.S. PATENT DOCUMENTS

| | | | |
|---|---|---|---|
| 4,560,327 | 12/1985 | Bez et al. . | |
| 4,705,460 | 11/1987 | Braun | 417/266 |
| 4,718,832 | 1/1988 | Takahashi . | |
| 4,790,726 | 12/1988 | Balkau et al. . | |
| 4,854,825 | 8/1989 | Bez et al. . | |
| 5,042,521 | 8/1991 | Shiomi . | |

FOREIGN PATENT DOCUMENTS

| | | | |
|---|---|---|---|
| 2154066 | 5/1973 | France . | |
| 2637654 | 4/1990 | France . | |
| 2666853 | 9/1991 | France . | |
| 0427404 | 7/1924 | Germany . | |
| 413461 | 5/1925 | Germany . | |
| 3740810 | 6/1988 | Germany . | |
| 3-009088 | 1/1991 | Japan | 417/266 |
| 674399 | 12/1978 | Switzerland . | |
| 0281624 | 7/1928 | United Kingdom . | |
| 1566577 | 5/1980 | United Kingdom . | |

*Primary Examiner*—Richard A. Bertsch
*Assistant Examiner*—William Wicker
*Attorney, Agent, or Firm*—Sughrue, Mion, Zinn, Macpeak & Seas

[57] ABSTRACT

A multistage vacuum pump is achieved by utilizing a single piston and cylinder assembly having opposite end portions with substantially equal diameters and an enlarged diameter central portion. One end of the cylinder is closed by a valve and a first stage pumping chamber is defined between the valve and the piston. The enlarged diameter portion of the piston has an axial extent less than the axial extent of the enlarged diameter portion of the cylinder to define second and third stage pumping chambers on opposite sides of the enlarged diameter portion of the piston. The three pumping chambers are interconnected by passage means to an inlet and outlet to provide a sequential reduction in pressure. A single drive unit may be connected to a plurality of pumping units for reciprocating the piston in each pumping unit.

8 Claims, 14 Drawing Sheets

FIG.7
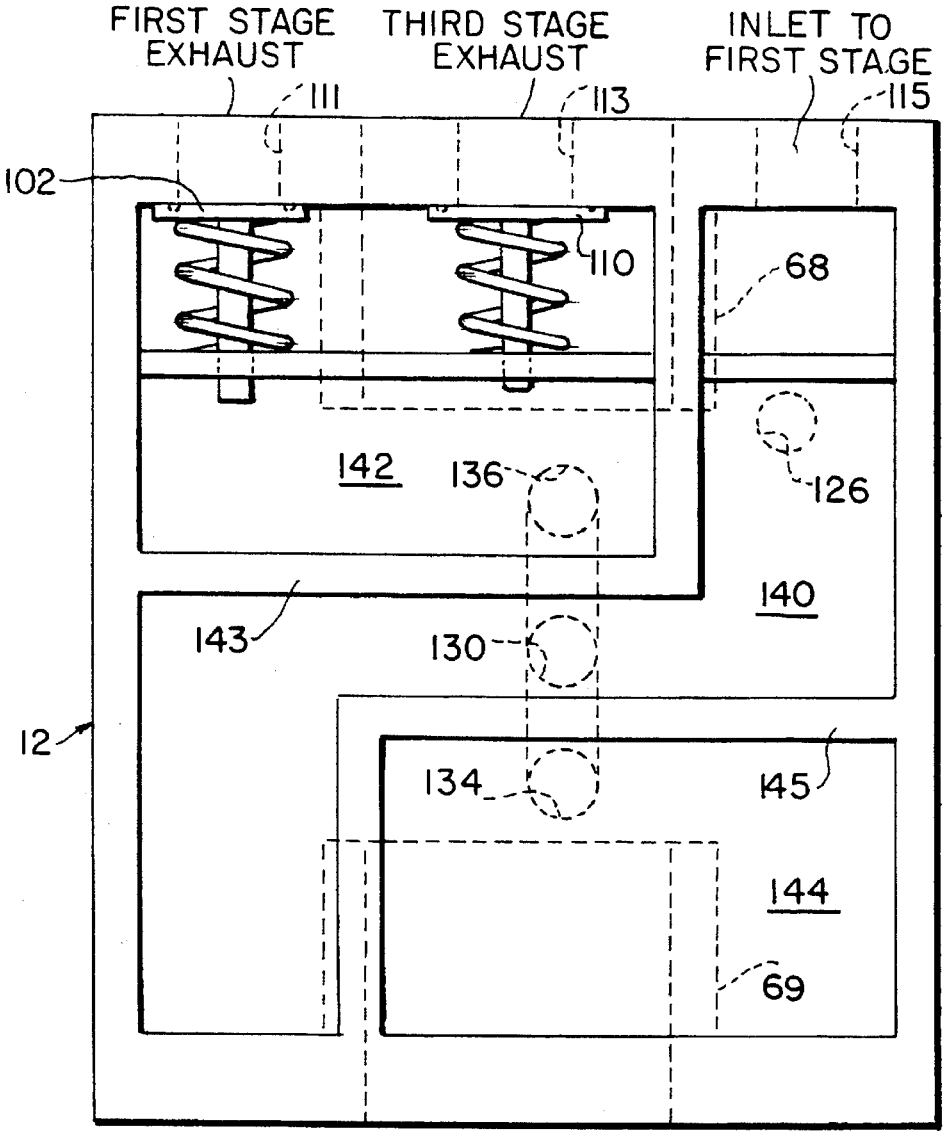
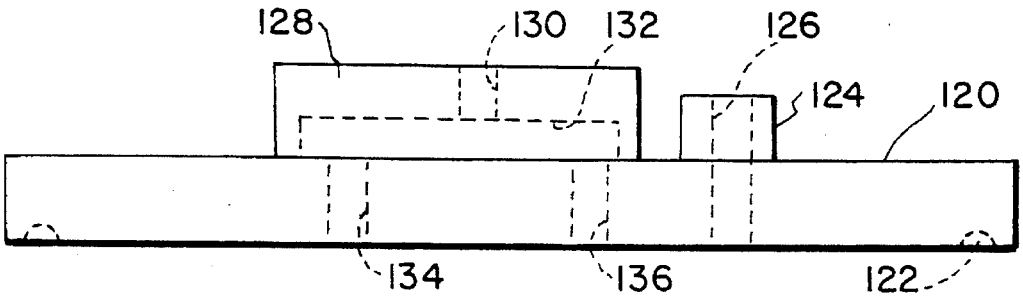
FIG.8

MULTISTAGE VACUUM PUMP

This is a Continuation-in-Part of application Ser. No. 07/993,860 filed Dec. 21, 1992, now abandoned.

BACKGROUND OF THE INVENTION

The present invention is directed to a multistage vacuum pump and more specifically to a multistage vacuum pump comprised of a single piston cylinder assembly having an enlarged diameter central portion with one end of the assembly and opposite sides of the enlarged diameter central portion providing three stages interconnected by passage means.

Australian patents numbers 481072 and 516210, which are both assigned to the same Assignee as the present application, disclose various forms of a reciprocatory piston and cylinder machine having a differential piston in two working spaces. In the practical application of such a machine, it is usual to provide multiple cylinders as respective stages of a multistage pump. The machine is particularly well suited for use as a mechanical vacuum pump utilizing solid sealing rings or sleeves in lieu of oil or other liquid lubricants. A four cylinder pump having a pair of parallel coupled high vacuum cylinders, jointly connected in series with a median vacuum cylinder and a low vacuum cylinder is particularly appropriate and has the advantage of being suitable for construction in well-balanced configurations. In prior pumps, the connections between such stages were made by covered passages and external conduits but these are not readily translated into an internal porting and ducting arrangement.

The U.S. Pat. No. 4,560,327 to BEZ et al., discloses a porting and ducting arrangement for a pair of adjacent cylinders of a multistage vacuum pump wherein a plurality of passages extend longitudinally in the walls of the cylinders and communicate with the interiors of the cylinders through respective ports. A plurality of recesses in the form of arcuate depressions may be located in the ends of the cylinder walls or in the bottom surface of the cylinder head which register with respective passages or groups of passages and suitable openings are provided in the cylinder head in communication with the recesses for supplying or exhausting fluid to or from the interiors of the cylinders. This patent is also assigned to the Assignee of the present application.

U.S. Pat. No. 4,790,726 in the name of Balkau et al. and assigned to the same Assignee as the present application, is also directed to a reciprocatory piston and cylinder machine adapted to be used as an oil-free vacuum pump. The vacuum pump disclosed in this patent is directed to a cylinder having a first portion closed at one end and a second portion contiguous with, but of smaller diameter than, the first portion and a piston having a cylinder head portion slidable in the first cylinder portion and a second cylindrical piston portion slidable in the second cylinder portion with said piston head portion having a front face facing the closed cylinder end and an annular back face. A gas inlet is provided for introducing gas to the interior of the first cylinder portion between the front face of the piston head portion and the closed cylinder end on reciprocation of the piston. A first exhaust port is provided for exhausting gas from the interior of the first cylinder portion ahead of the piston head portion by pumping action of the front face of the piston head portion, a one-way valve is provided in the first exhaust port which is operable to permit the exhaust of gas from the interior of the first cylinder portion ahead of the piston head portion and a second exhaust port is provided for the exhaust of gas from the interior of the first cylinder portion behind the piston head portion by the pumping action of the back face of the piston head portion. Sealing means are provided for the piston head portion which includes a sleeve of low friction material disposed on the cylindrical surface of the piston such that over the temperature range encountered during the normal operation of the pump, a mean gap is sustained between the sleeve and the cylinder, which gap is of a maximum size at which leakage of gas past the sleeve is at a level for an acceptable degree of vacuum to be sustained by the pump. A similar sleeve is provided on the second piston portion and resilient means are provided adjacent the end of the sleeve remote from the first piston portion for forcing the sleeve into sliding engagement with the wall of the cylinder. Furthermore, the one way valve in the exhaust port is provided with projecting means which are adapted to be engaged by the piston for opening the valve in the exhaust port controlled thereby on each stroke of the piston even though the pressure within the cylinder is too low to open the valve against the force of the spring biasing the valve into normally closed position.

U.S. Pat. No. 4,854,825 to BEZ et al. and assigned to the same Assignee as the present application, discloses an oil-free, multistage vacuum pump having the cylinders, crankcase and passage means formed in a single casting with two pairs of cylinders opposed to each other in a substantially common plane on opposite sides of the axis of crankshaft support means extending perpendicular to the axes of the cylinders. Each cylinder is provided with a large diameter portion adjacent the cylinder head and a smaller diameter portion adjacent the axis of the crankshaft. A step piston is reciprocally mounted in each sleeve and is operatively connected to a crankshaft for rotation in the crankcase. One pair of piston cylinder assemblies are considered the high pressure pumping assemblies while the other pair of pistons and cylinder assemblies are considered to be the low pressure pumping assemblies. While such a vacuum pump is capable of providing extremely low pressures, the need for the four piston and cylinder assemblies makes the size and weight of the pump much too great and the noise level is too high. Furthermore, such a multistage vacuum pump is very complicated in construction and it requires too many parts and is far too expensive.

One particular feature of the foregoing multistage vacuum pump which presents a great difficulty is the requirement of four atmospheric seals. As the pump requires four pistons for the operation, each piston carries on its small diameter, a flexible seal to prevent leakage of atmospheric pressure air into the working parts of the pump. It would indeed be desirable to prevent any leakage of atmospheric air into or out of the pumps. Not only can air leak into the pump, but exhaust gasses can also leak out of the pump, particularly at the fourth stage of compression where the pressure exceeds atmospheric pressure inside the pump. The same can happen in all cylinders during the high pressure operation, that is, when pumping out a vessel from atmospheric pressure.

SUMMARY OF THE INVENTION

The present invention provides a new and improved oil-free, multistage vacuum pump which eliminates the various shortcomings of the aforementioned pumps.

The present invention provides a new and improved oil-free, multistage vacuum pump which utilizes only a single piston and cylinder assembly having an enlarged diameter central portion with an end portion and opposite side portions of the enlarged diameter portion providing three compression stages which can be connected in at least three different ways to provide different modes of operation.

The present invention provides a new and improved oil-free, multistage vacuum pump having a single piston and cylinder assembly with the cylinder and inlet passages for each stage being formed within the castings forming the housing of the pump.

The present invention provides a new and improved oil-free, multistage vacuum pump having a single piston and cylinder assembly with valving means including a spring biased valve assembly and an electromagnetic or mechanical valve assembly with a smaller opening than the spring biased valve assembly disposed in parallel at an outlet of a first stage and at least one valve assembly disposed at an outlet of second and third stages respectively which may be either spring biased valve assemblies or electromagnetic valve assemblies.

The present invention provides a new and improved oil-free, multistage vacuum pump comprising a drive unit having a motor driven crankshaft in a cast aluminum housing and at least one pumping unit having a single multistage piston and cylinder assembly operatively connected to the crankshaft wherein the housing of the drive unit is provided with sealing means and a one-way valve connected to one stage of said pumping unit to maintain said housing of the drive unit at sub-atmospheric pressure and wherein said drive unit is provided with means for connecting additional pumping units and with integral internal passage means formed within the housing of the drive unit for interconnecting multiple pumping units.

The present invention provides a new and improved oil-free, multistage vacuum pump wherein at least two pumping units are connected to a common drive means with the two pumping units connected in parallel or in series to provide different pumping capacities.

The present invention provides a new and improved oil-free, multistage vacuum pump having a single piston and cylinder assembly with valving means wherein each of the valving means for controlling the various stages of the pump are in the form of self-contained cylindrical cartridges which may be inserted in the end faces of the housing parts prior to interconnection to facilitate assembly of the pump and to replacement of the individual valve assemblies.

The foregoing and other objects, features and advantages of the invention will be apparent from the following more particular description of a preferred embodiment of the invention as illustrated in the accompanying drawings.

BRIEF DESCRIPTION OF THE DRAWINGS

FIG. 7 is a top plan view of the drive unit with the cover plate removed.

FIG. 8 is a side elevational view of the cover plate for the drive unit.

DETAILED DESCRIPTION OF THE INVENTION

Figure 1:
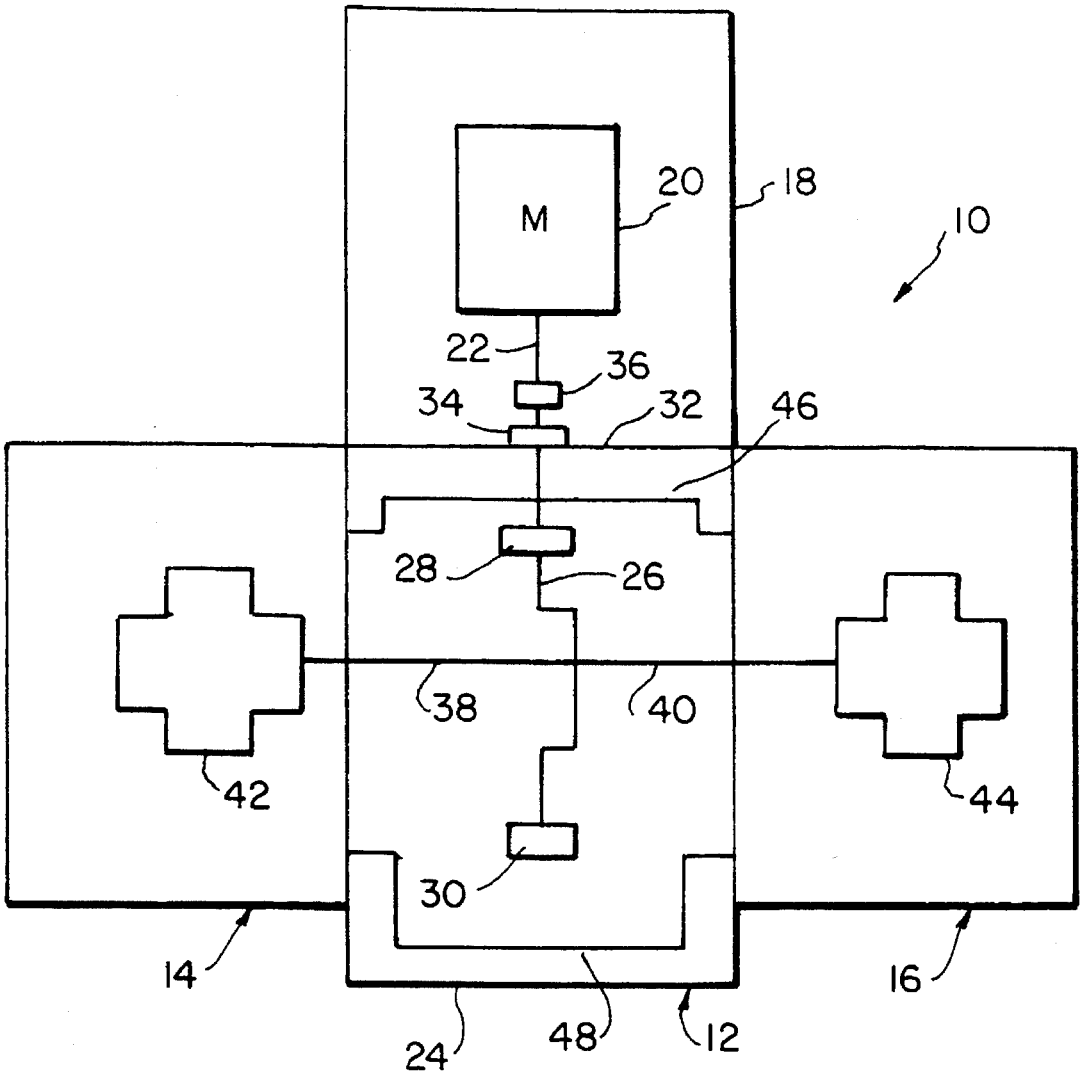
FIG. 1 is a schematic plan view of a drive unit having two pumping units connected thereto with each pumping unit being an oil-free multistage vacuum pump having a single piston and cylinder assembly.

The vacuum pump 10 shown schematically in FIG. 1 is comprised of a drive unit 12 and two pumping units 14 and 16 mounted on opposite sides of the drive unit 12. The drive unit or drive module 12 includes a housing 18 supporting an electric motor 20 having an output shaft 22. The housing 18 is secured to a transmission housing 24 to which the two pumping units or pumping modules 14 and 16 are secured. A crankshaft 26 is rotatably mounted within the housing 24 on bearings 28 and 30. The crankshaft 26 extends through the end wall 32 of the housing and is hermetically sealed relative to the housing 24 by means of a sealing member 34 of any suitable design. The output shaft 22 of the motor 20 is connected to the crankshaft 26 by means of a coupling 36. While two pumping modules 14 and 16 have been illustrated in FIG. 1, only a single pumping module need be used or as many as four pumping modules can be secured to the drive module 12 for operation by a common motor 20. As shown in FIG. 1, a pair of piston rods 38 and 40 are connected to the crankshaft 26 and to respective pistons 42 and 44 shown schematically in the pumping modules 14 and 16, respectively.

The transmission housing 24 is of cast aluminum material and includes a pair of integral passages shown schematically at 46 and 48 which provide inlet and outlet passages respectively for the respective pumping modules 14 and 16. Suitable inlet and outlet fittings (not shown) would be connected to the passages 46 and 48 respectively for connection to the device to be evacuated and the atmosphere or a suitable receptacle in the event toxic gasses are involved.

Such fittings would extend through the cover or a wall of the transmission housing 12 in fluid communication with the respective passages 46 and 48.

Each of the pumping units 14 and 16 is an oil-free, multistage vacuum pump and since the pumping units are identical, a detailed description will be provided with respect to the pumping module 14.

Figure 2:
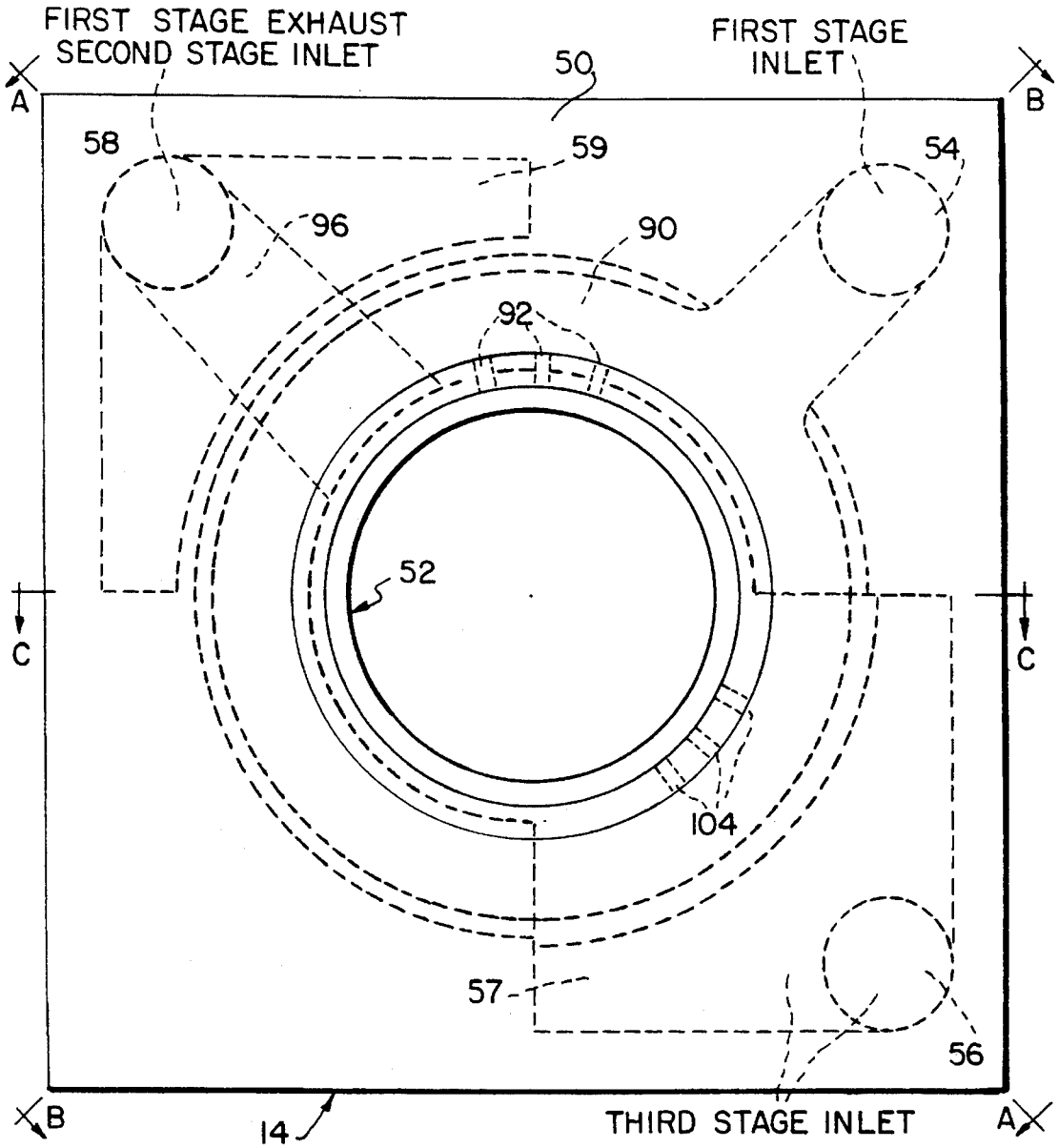
FIG. 2 is an end elevation view of a pumping unit.
Figure 3:
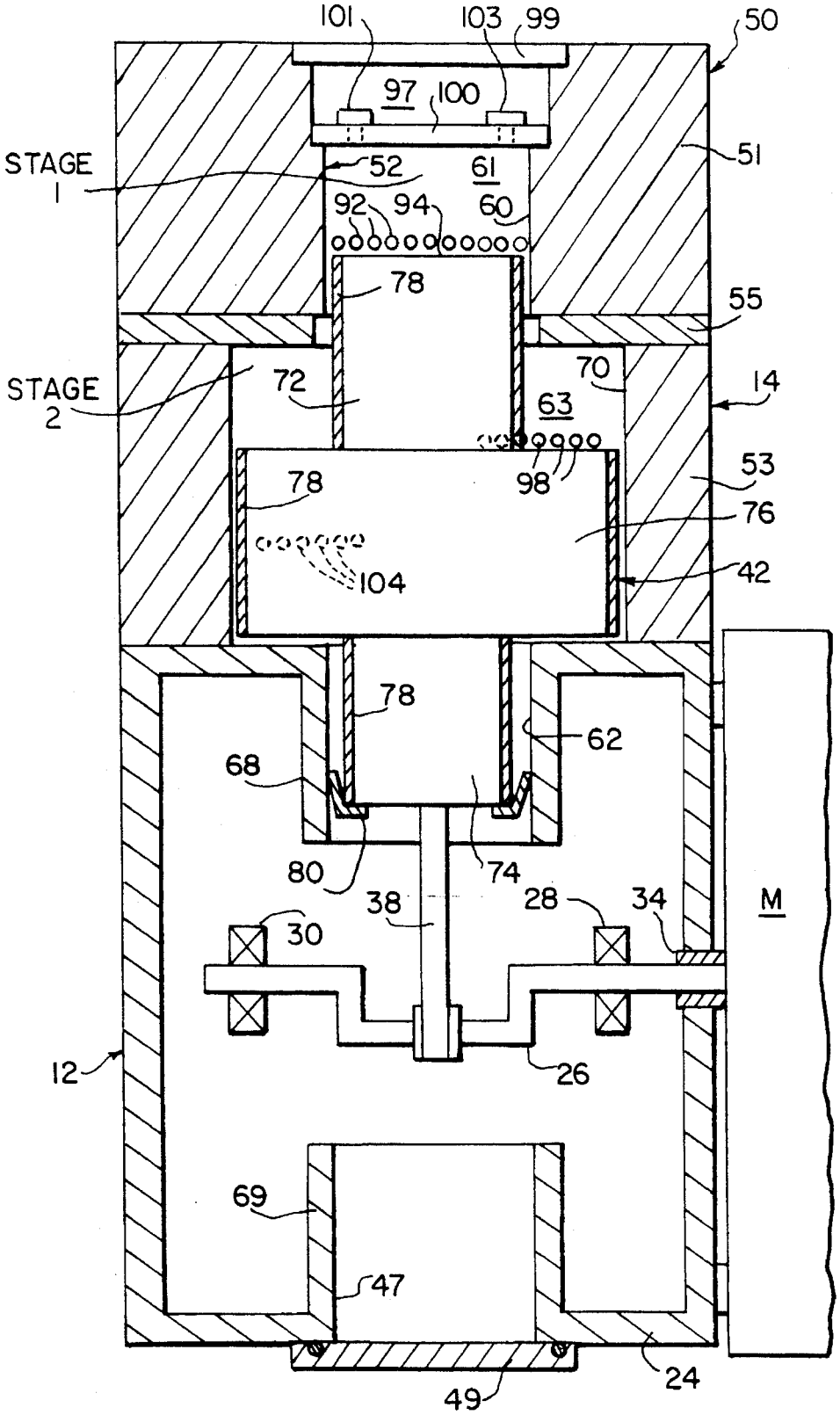
FIG. 3 is a sectional view of the pumping unit taken along the line C—C of FIG. 2 with the piston disposed in the bottom dead center position.
Figure 4:
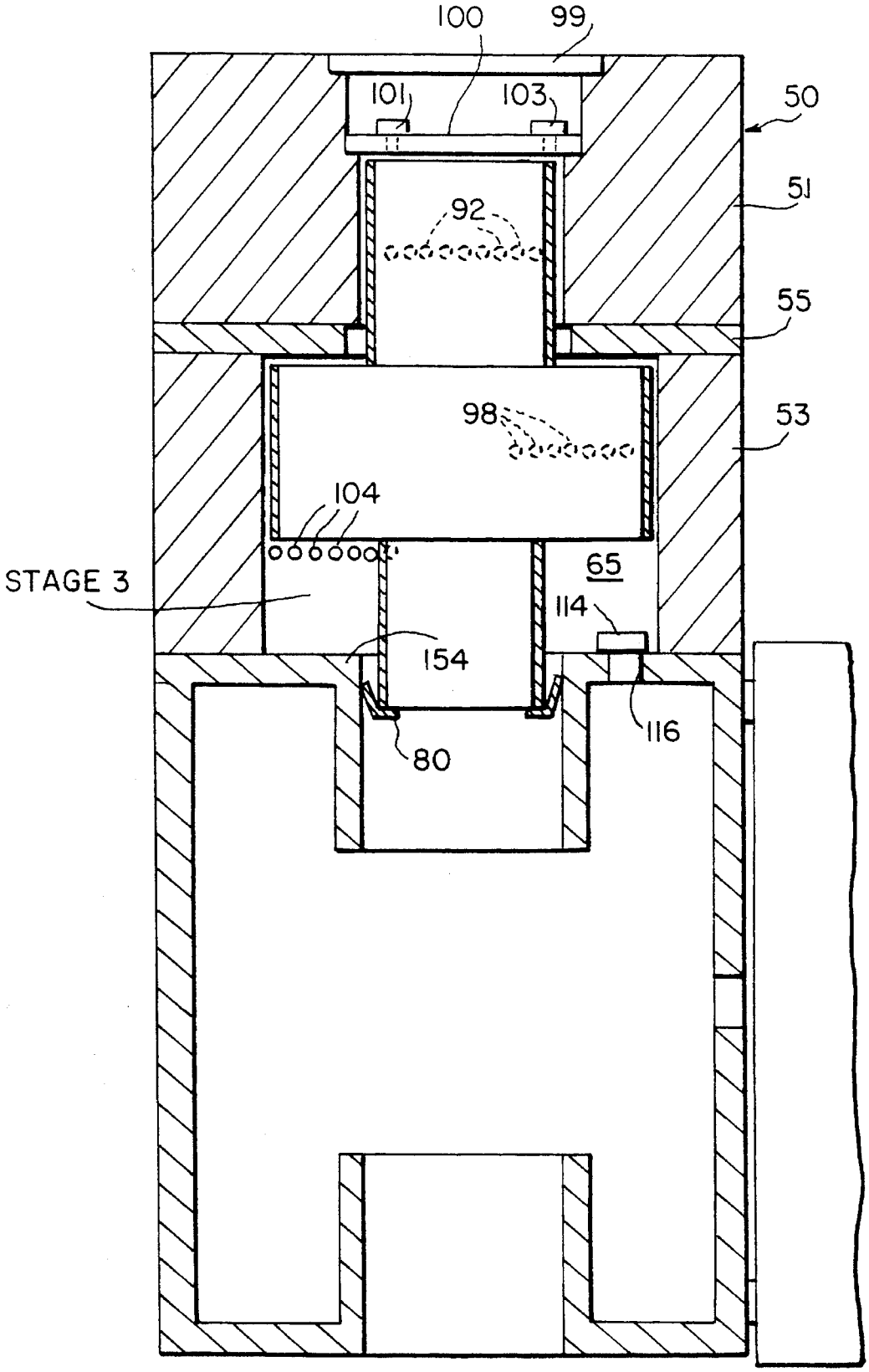
FIG. 4 is a sectional view similar to FIG. 3 with the piston in the top dead center position.
Figure 5:
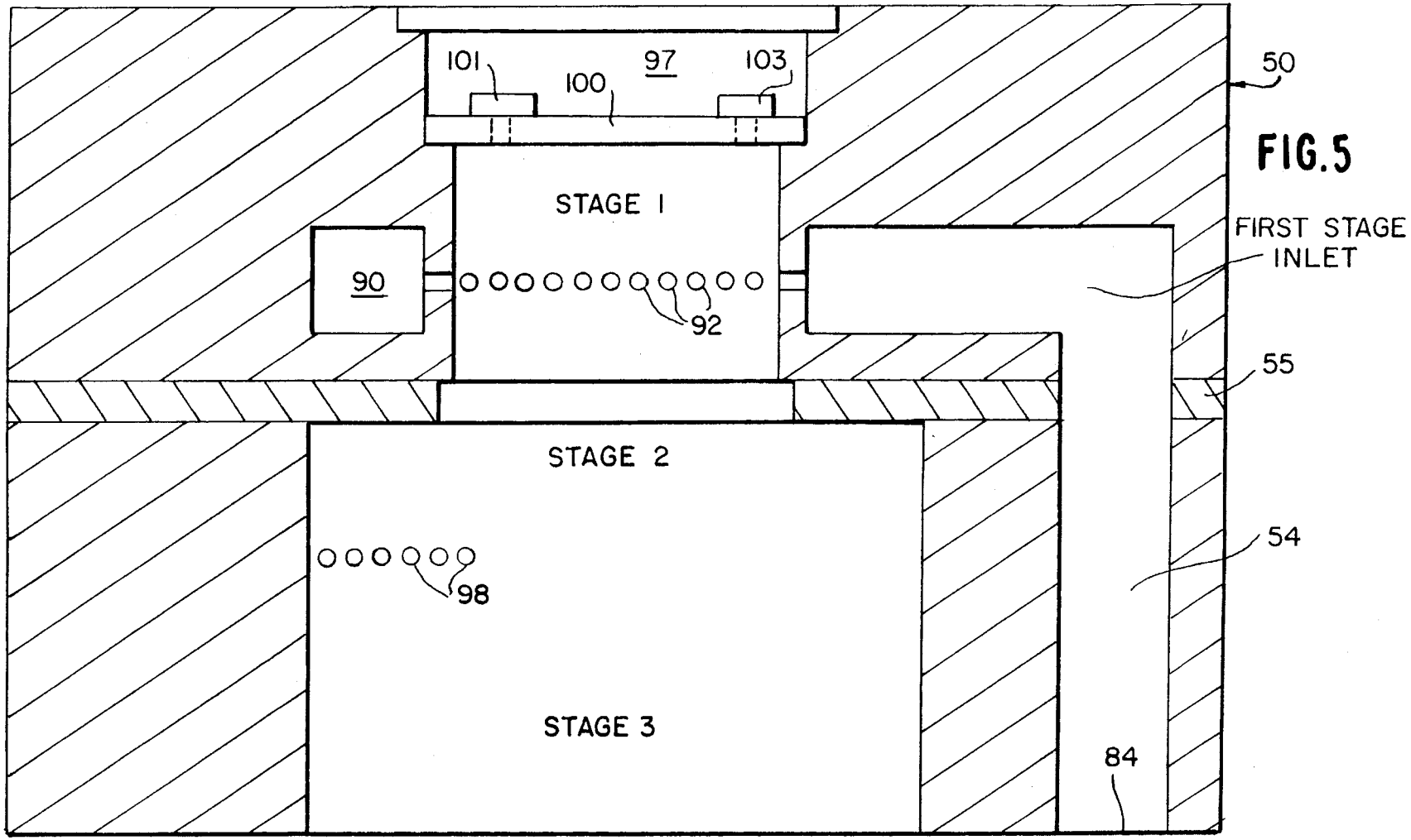
FIG. 5 is a sectional view of the pumping unit taken along the line B—B of FIG. 2 with the piston removed.
Figure 6:
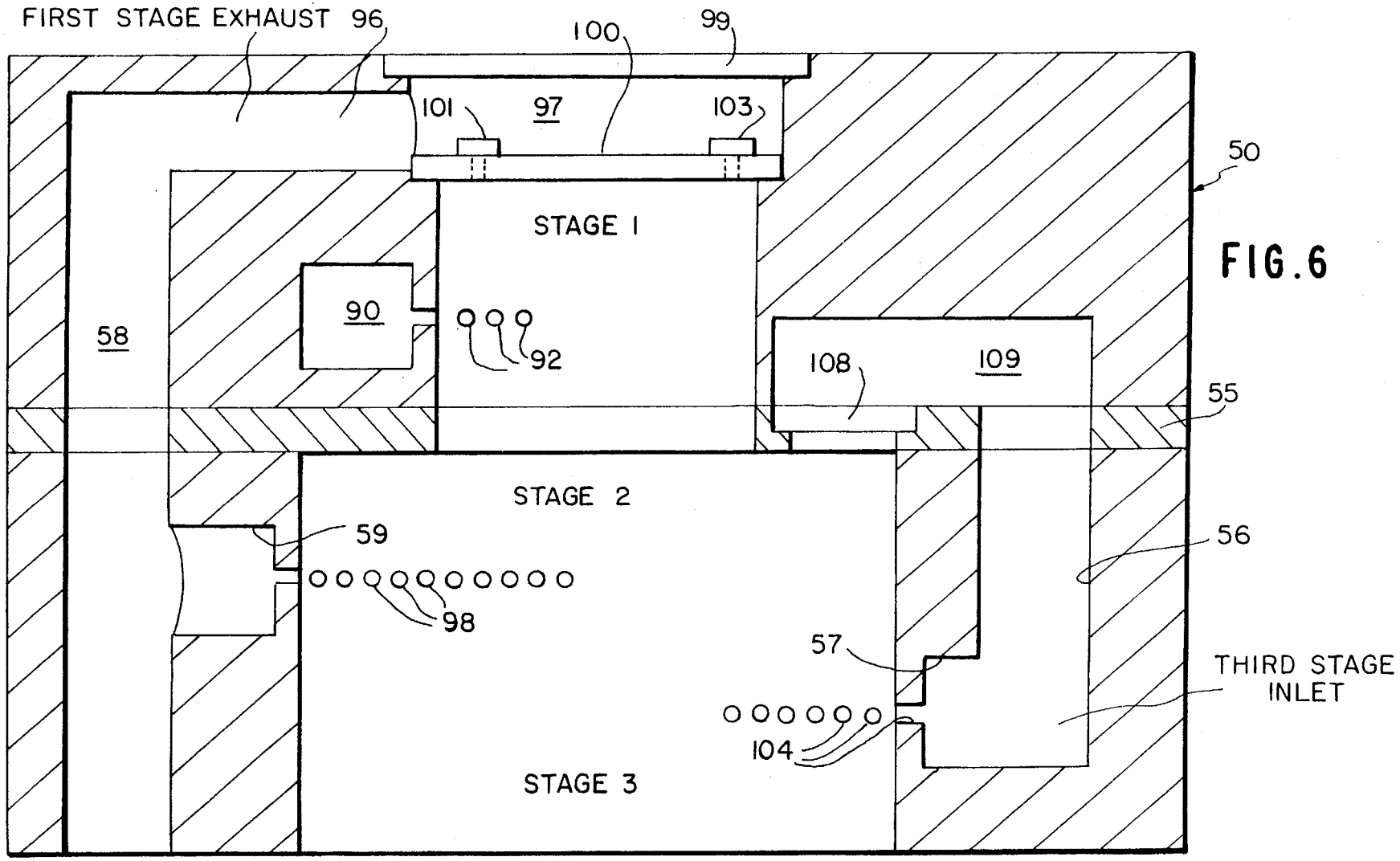
FIG. 6 is a sectional view of the pumping unit taken along the line A—A in FIG. 2.

The pumping module 14, as shown in FIGS. 2–6, is attached to the drive unit 12 by any suitable means (not shown) and is comprised of a cast aluminum housing 50 having a variable diameter cylinder 52 and three passages 54, 56 and 58 integrally formed therein in parallel with each other and the cylinder during the casting process. The cylinder and inlet passages extend through the housing 50 relative to each other as best seen in FIGS. 2, 5 and 6.

The cylinder 52 is provided with two end portions 60 and 62 of approximately equal diameter with the end portion 62 being located in a cylindrical portion 68 of the housing 24 of the drive unit. The cylindrical portion 68 extends into the housing 24 of the drive unit 12 as seen in FIG. 3. A similar cylindrical portion 69 is formed in the opposite wall of the housing 24 which will form a part of the cylinder of a second pumping unit, such as the pumping unit 16 which is shown in FIG. 2 as being on the opposite side of the drive unit 12 from the pumping unit 14. Since the interior of the drive unit 12 must be maintained at sub-atmospheric pressure, a suitable cover 49 may be secured over the opening 47 in order to provide a hermetically sealed closure.

The cylinder 52 is also provided with a central larger diameter portion 70 intermediate the two smaller diameter portions 60 and 62. The pumping unit 14 includes a hollow piston 42 which is provided with two approximately equal diameter end portions 72 and 74 and an enlarged diameter middle portion 76. The top end 94 of the end portion is closed and the bottom end of the end portion 74 is open. The piston is covered on all cylindrical surfaces with a low-wear material 78 having a low coefficient of friction. The material is applied in such a manner as to not cause any mechanical interference with the cylinder walls when the piston expands. The covering material 78, the piston 42 and cylinder housing 50 each have the same co-efficient of expansion. The piston 42 and the cylinder housing 50 may be formed of aluminum or other material such as stainless steel which may be used for the piston. The covering material 78 may be substantially identical to that disclosed in the Balkau et al. patent U.S. Pat. No. 4,790,726 wherein a sleeve of bronze-filled polytetrafluoroethylene (PTFE) is used. Other types of filler material may also be used to provide low wear. As in the Balkau et al. patent, the layer of low friction, low wear material disposed on the cylindrical surfaces is such that over the temperature range encountered during the normal operation of the pump, a mean gap is sustained between the sleeve and the cylinder, which gap is of a maximum size at which leakage of gas past the sleeve is at a level for an acceptable degree of vacuum to be sustained by the pump. A cup-shaped contact seal 80 of similar material is secured to the open end of the smaller diameter portion 74 to prevent the entry of higher pressure gasses in the interior of the drive unit 12 from entering into the working space of the pump. The cylinder housing 50 is comprised of two separate castings 51 and 53 and an intermediate valve plate 55. The three components of the housing 50 are secured to each other by any suitable means (not shown). The main inlet passage 54 for the pump extends through the cylinder housing 50 as best seen in FIGS. 2 and 5. The end 84 of the inlet passage 54 is disposed in alignment with the inlet passage 115 extending through the end wall of the drive unit 12 as shown in FIG. 7 which in turn is connected to an inlet adapted to be connected to the object being evacuated as will be described hereinafter.

The upper end of the inlet passage 54 as viewed in FIG. 5, is connected to a passage 90 which extends approximately 270° about the end portion 60 of the cylinder 52 as best seen in FIG. 2. The circumferential passage 90 communicates with the interior of the portion 60 of the cylinder 52 through a plurality of radial passages 92 which extend in a circumferential line located immediately above the top closed end 94 of the piston 42 when the piston 42 is located at the bottom dead center position as illustrated in FIG. 3.

A valve plate 100 is secured to the top end of the cylinder 52 as shown in FIG. 3 by any suitable means (not shown). The volume 61 between the valve plate 100 and the upper end 94 of the piston 42 defines stage 1 of the multistage pump. The valve plate 100 is provided with a pair of valves 101 and 103 which allow the passage of gas from the cylinder upon upward movement of the piston 42. The valve 101 may be an electromagnetically controlled valve while the valve 103 is a spring-biased one-way valve. An outlet chamber 97 is defined between a cover plate 99 which is hermetically connected to the housing 50 and the valve plate 100. The chamber 97 communicates with the passage 58 in the housing 50 through a lateral passage 96. The passage 58 which is best seen in FIGS. 2 and 6, constitutes a first stage exhaust passage and a second stage inlet passage.

The passage 58, together with the lateral passage 96, should have a volume which is approximately equivalent to the volume displaced from stage 1 to minimize pressure build-up in the passage 58. The passage 58 is also connected to a high pressure outlet via the one way valve 102 located in the drive unit as shown in FIG. 7.

The passage 58 communicates with the large diameter portion 70 of the cylinder through a plurality of apertures 98 by means of a substantially arcuate passage 59 which is best seen in FIGS. 2 and 6. The apertures 98 are disposed in a circumferential line which is exposed by the enlarged diameter portion 76 of the piston 42 which the piston is at its bottom dead-center position as shown in FIG. 3. The annular space 63 above the enlarged diameter portion 76 of the piston 42 defines stage 2 of the multi-stage pump.

Upon movement of the piston 42 from the bottom dead-center position toward the top dead-center position, the apertures 98 will be closed and the gasses in stage 2 will be forced outwardly through a one-way valve 108 located in the valve plate 55 which is secured between the housing portions 51 and 53. Upon passing through the spring-biased one-way valve 108, the gasses enter a lateral passage 109 which intersects with the passage 56 which extends parallel to the cylinder 52. The lower end of the passage communicates with a lateral passage 57 which extends about substantially 90° of the circumference of the cylinder 52 as best seen in FIGS. 2 and 6. The lateral passage 57 communicates with the interior of the enlarged diameter portion 70 of the cylinder 52 through a plurality of radially extending passages 104 which are disposed in a circumferential line and which are exposed when the piston 42 reaches the top dead-center position as shown in FIG. 4. Thus, the gasses expelled from stage 2 will enter stage 3 of the multi-stage pump which is defined by the space 65 between the enlarged diameter portion 76 of the piston 42 and the end wall of the housing 24 of the drive unit 12.

The upward movement of the piston 42 from the bottom dead-center position of FIG. 3 to the top dead-center position of FIG. 4 will result in a reduction of pressure within stage 3 thereby allowing a one-way valve 114 to open in response to the higher pressure gasses in the interior of the drive unit 12 so that the gasses in the drive unit 12 will pass through the opening 116 into stage 3. This will maintain the interior of the drive unit 12 below atmospheric pressure.

Upon movement of the piston 42 from the top dead-center position to the bottom dead-center position, the gasses in stage 3 will be expelled through the passage 113 controlled by the spring-biased one-way valve 110 mounted within the drive unit 12 as shown in FIG. 7. Thus, the pumping action achieved by the three stages of the multi-stage pump substantially reduces the pressure in a vessel which has been connected to the inlet 126 of the drive unit 12.

Figure 9:
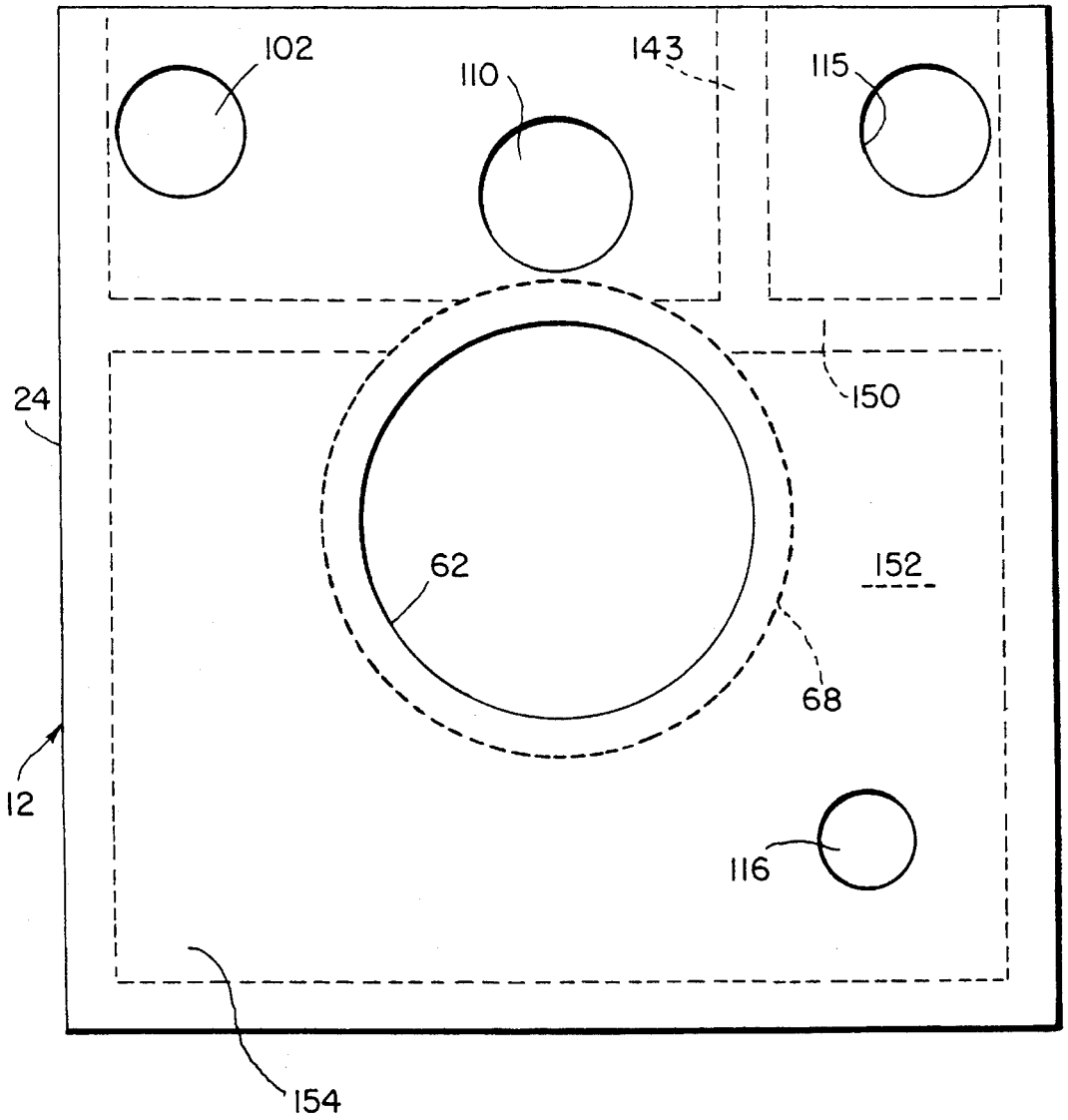
FIG. 9 is an end elevational view of the drive unit with the pumping unit removed.

The drive unit 12 which is normally disposed in the position shown in FIG. 9, is provided with a transverse partition 150 which defines a lower chamber 152 in which the drive mechanism is located which interconnects the motor 20 to the piston 42. The passage 116 shown in the end wall 154 of the drive unit 12, is also shown in FIG. 4 and is controlled by the spring-biased one-way valve 114. As mentioned previously, the crankshaft 26 extends through a side wall 32 of the drive unit and is hermetically sealed relative thereto by the seal 34. Thus, as a result of the pumping action, the pressure is reduced in the lower chamber 152 so as to reduce the possibility of gasses forcing their way past the contact seal 80 secured to the lower end of the piston which operates in the reduced diameter portion 62 of the cylinder defined by the cylindrical projection 68 which extends into the drive unit 12 as shown in FIG. 3.

The upper portion of the housing 24 of the drive unit 12 is divided into three separate chambers 140, 142 and 144 by means of partitions 143 and 145 as best seen in FIG. 7. The drive unit 12 is provided with a cover 120 shown in FIG. 8 which is adapted to be hermetically sealed to the top of the housing 24 by means of the seals 122 extending about the entire periphery of the cover. Similar seals can be provided for engagement with the upper surfaces of the partitions 143 and 145. Thus, the three chambers 140, 142 and 144 will be hermetically sealed relative to each other when the cover 120 is secured to the housing 24 by any suitable means (not shown).

A fitting 124 is secured to the upper surface of the cover 120 to provide a connection to whatever device is to be evacuated by means of the multi-stage vacuum pump. The inlet passage 126 extends through the fitting 124 and the cover 120 into communication with the Z-shaped passage 140 as shown in FIG. 7 which in turn is provided with the passage 115 which is disposed in communication with the inlet passage 54 in the housing 50 of the pumping unit 14 whereby the gasses can pass to stage 1.

The first stage exhaust passage 111 in the drive unit housing 24 which is in communication with the passage 58 in the drive unit 14, is also in communication with the chamber 142 through the spring-biased one-way valve 102 which is located within the chamber 142. The third stage exhaust passage 113 in the housing 24 of the drive unit is in communication with the exhaust passage 112 leading from stage 3 and is also in communication with the chamber 142 controlled by the spring-biased one-way valve 110. Thus the chamber 142 is an exhaust chamber and is connected through the passages 136, 132 and 130 to the atmosphere as shown in FIGS. 7 and 8. If a second pumping unit is attached to the opposite side of the drive unit 12 with the reduced diameter end portion of the piston located in the cylindrical projection 69 in FIG. 7, the chamber 144 would also act as an exhaust chamber and the gasses therein would be exhausted through the atmosphere through the passages 134, 132 and 130. Also, a second inlet would be provided for the chamber 140 and passages equivalent to the passages 111, 113 and 115 would be formed in the end walls adjacent the cylindrical projections 69.

In operation, the vessel to be evacuated is connected to the fitting 124 on the cover 120 of the drive unit and gas will pass through the passage 126, the chamber 140 and the passage 115 into the inlet passage 54 in the drive unit 14. The gas will then enter the compression space of stage 1 via the holes 92 disposed around the circumference of the cylinder wall when the piston is near bottom dead-center. When the piston leaves the bottom dead-center position as shown in FIG. 3, the gas which has entered the compression space of stage 1, will reach a higher pressure and will be expelled through either the electromagnetically operated valve 101 or the spring-biased one-way valve 103.

The gas is now transferred via the chamber 97, the passage 96 and the passage 58 to stage 2 through the passage 59 and the holes 98 which are uncovered when the piston 42 is at the bottom dead center position. The gas in stage 2 is expelled via the one-way valve 108, through the passages 109, 56 and 57 and enters stage 3 through the ports 104 which are uncovered as the piston approaches the top dead-center position as shown in FIG. 4. The gas in stage 3 is expelled through the one-way valve 110 into the chamber 142 of the drive unit 12 from which it will then exhaust to the atmosphere. The gas could be collected in a separate vessel in situations where the gas is of a toxic nature. Any gas leaking past the contact seal 80 at the lower end of the piston 42 will also enter stage 3 and be expelled in the same manner. Likewise, the pressure in chamber 152 of the drive unit 12 will be reduced when the piston moves from the bottom dead-center position to the top dead-center position at which time the pressure in stage 3 will be substantially reduced allowing the one-way valve 114 to open. The one-way valve 114 permits gas to enter stage 3 to lower the pressure in the drive unit to about 1/10 of an atmosphere. It is important to make sure that the pressure in the drive unit is not so low as to prevent heat transfer from the internal mechanism of the drive unit and the pumping unit via the gas (convection) to the walls or surfaces of the housing which are of aluminum.

The electromagnetic valve 101 which controls the exhaust of gasses from stage 1 is normally spring-biased to a closed position and is located in a relatively small opening having a diameter of approximately 1/16 of an inch. The spring-biased one-way valve 103 is located in an opening approximately 100 times the area of the opening of the electromagnetic valve. During the initial pumping stages the spring-biased valve will operate to allow the high pressure gasses from stage 1 to flow to the passage 58 and from there to the exhaust chamber 142 in the drive unit 12 through the high pressure valve 102 and to the second stage. As the pressure is reduced on subsequent strokes of the piston, the electromagnetic valve is used to guarantee the opening of the passage between the first and second stages. The electromagnetic valve is phased to open before the piston reaches the top dead center and closed before descent of the piston. The outlet passages from the second and third stages can be controlled by either a spring-biased valve as shown, which is normally closed or a combination of valves similar to that described above with respect to the first stage outlet.

In the operation of the dry multi-stage vacuum pump described above, the sliding velocity (V) of the piston should be limited to below 300 feet/minute (1.5 m/sec). The pumping speed of one complete pumping unit should be 100 l/min with the ultimate pressure of 20 mTorr. In practice, this means that the ultimate pressure should be much less than 20 mTorr when new to allow for wear.

The motor in the drive unit should be capable of 1800 rpm which is a commonly available speed. The stroke of the piston should be at least 25.4 mm to obtain good compression in the high vacuum stage.

The mass of the piston and associated mechanical parts is kept to an absolute minimum because of considerations of vibration, noise and energy. It is therefore important to make the piston as small as possible while preventing undue increases in rotational velocity.

Figure 10:
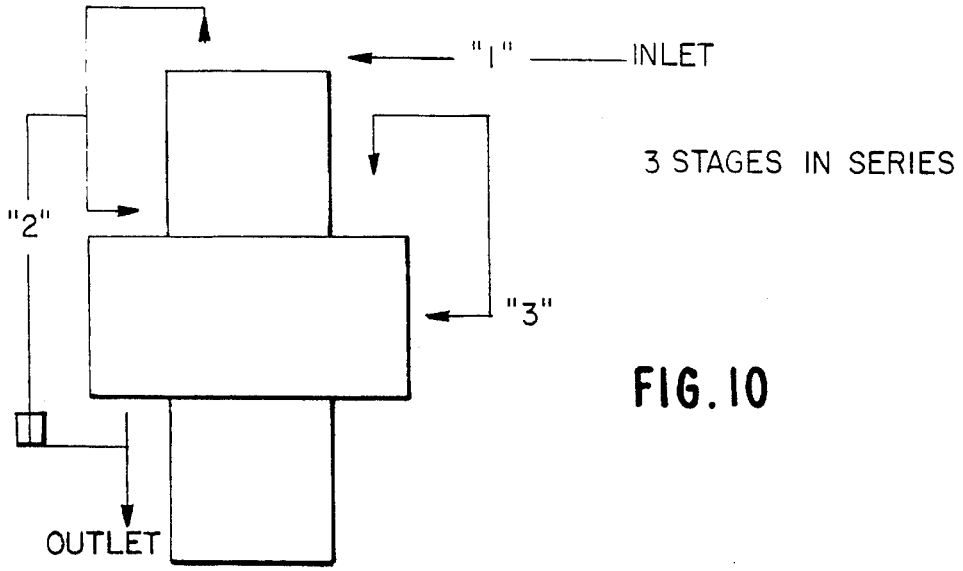
FIG. 10 is a schematic view of a piston and the fluid flow paths between the three stages with the three stages connected in series.
Figure 11:
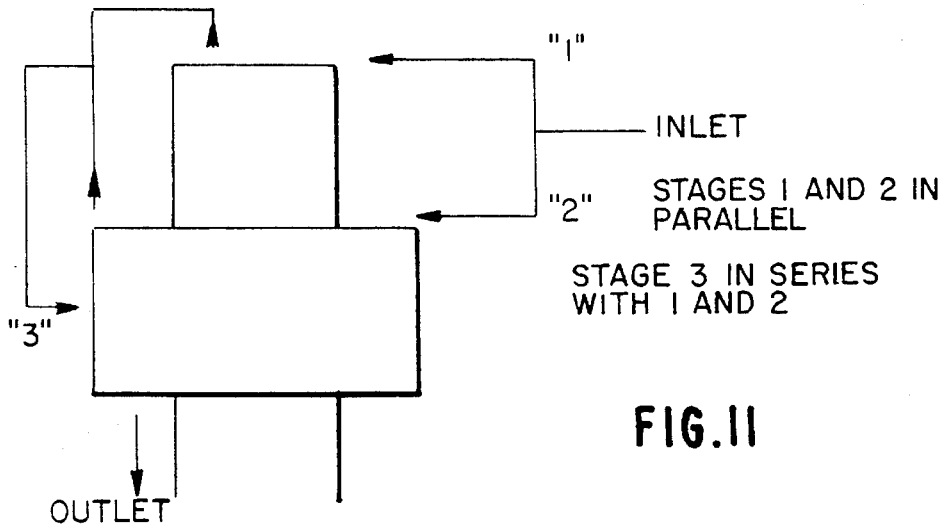
FIG. 11 is a schematic view of a piston and the flow paths between the stages with stages 1 and 2 connected in parallel and stage 3 connected in series with stages 1 and 2.
Figure 12:
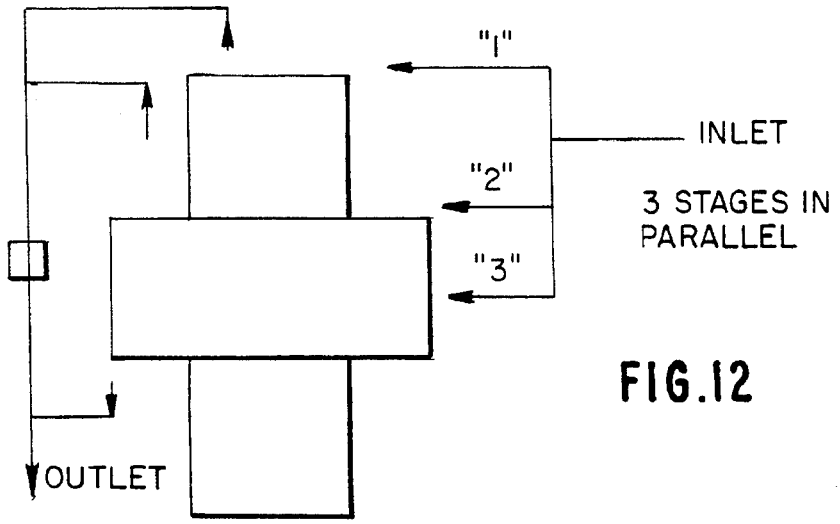
FIG. 12 is a schematic view of a piston and flow path connecting the three stages with the three stages connected in parallel.

As explained above, the single piston having smaller diameter end portions and a large diameter middle portion will divide the space within the cylinder into three compression spaces or stages which can be connected in three different ways. Stages 1, 2 and 3 can all be connected in series as shown in FIGS. 2–6 of the present application and as shown schematically in FIG. 10. Stages 1 and 2 can also be connected in parallel and stage 3 can be connected in series with stages 1 and 2 as shown schematically in FIG. 11 or stages 1, 2 and 3 can all be connected in parallel as shown schematically in FIG. 12. The different connections of the stages can readily be accomplished during the manufacture of the pumping unit by varying the location and connection of the passages in the pumping unit. When stages 1 and 2 are connected in parallel with each other and in series with stage 3, it is possible to operate the multi-stage pump as a medium pumping speed and medium ultimate pressure pump. When the stages are all connected in series, the pump can operate at a low pumping speed with very good ultimate pressure. When the three stages are connected in parallel, it is possible to operate the pump at a high pumping speed and at a higher pressure.

While the foregoing embodiment was directed to a single pumping unit connected to a drive unit, the following embodiment shown in FIGS. 13–20 provides two pumping units connected to the same drive unit. The multi-pump assembly shown in FIG. 13 includes a drive unit 200 having a first pump unit 202 and a second pump unit 204 mounted on opposite sides thereof. A motor unit 206 is detachably connected to one side of the drive unit 200 and includes an electric motor M having an output shaft 208 coupled to a crankshaft 210 by means of a coupling unit 212 secured to the two shafts by splines 214 and 216, respectively. The crankshaft 210 is rotatably mounted in the drive unit 200 by means of bearings 218 and 220. The crankshaft 220 is provided with two crank pins 222 and 224 which are 180° out of phase with each other.

The pump units 202 and 204 are identical to each other and are similar in some aspects to the pump unit 14 shown in the first embodiment. The pump unit 202 is comprised of two main castings 226 and 228 having circumferentially extending fins thereon for cooling purposes. The castings may be of aluminum or any other suitable material.

The casting 226 is provided with a stepped cylindrical bore having a first smaller diameter cylindrical portion 230 in which the piston will reciprocate and a second larger diameter cylindrical portion 232 adapted to receive a valve cartridge 234 which will be described in detail hereinafter.

The second casting 228 is provided with a cylindrical bore 236 having a larger diameter than the bore 230 in the casting 226. The casting 238, which forms the housing for the drive unit 200, is also provided with a cylindrical bore 240 having a diameter substantially equal to the diameter of the bore 230 in the first casting 226. Thus the three cylindrical bores 230, 236 and 240 provide a stepped cylinder similar to the stepped cylinder in the first embodiment for receiving a complementary stepped piston 242 therein. The two casting portions 226 and 228 are connected to each other by suitable means with a sealing ring 242 therebetween and the casting 228 is in turn connected to the housing 238 of the drive unit 200 by any suitable means such as bolts or the like with a sealing ring 248 disposed therebetween.

The piston 242 may be a hollow piston similar to the previous embodiment which is provided with two substantially equal diameter end portions 250 and 252 and an enlarged diameter middle portion 254. As in the previous embodiment, the piston is covered on all cylindrical surfaces with a low-wear material having a low coefficient of friction. The material is applied in such a manner as to not cause any mechanical interference with the cylinder walls when the piston expands. The covering material, the piston and the cylinder housing all have the same coefficient. The piston 242 and the castings 226, 228 and 238 may be formed of aluminum or other materials. The covering material 78 may be substantially identical to that disclosed in the Balkau et al. patent (U.S. Pat. No. 4,790,726) wherein a sleeve of bronze-filled polytetrafluorothylene (PTFE) is used. Other types of filler material may also be used to provide low wear. The layer of low friction, low wear material disposed on the cylindrical surface is such that in a temperature range encountered during the normal operation of the pump, a mean gap is sustained between the sleeve and the cylinder, which gap is of a maximum size at which leakage of gas pass the sleeve is at a level for an acceptable degree of vacuum to be sustained by the pump.

The lower end of the piston which is slidably disposed within the cylindrical portion 240 of the drive unit 200 is provided with a cup-shaped contact seal 256 which is biased outwardly into engagement with the cylindrical surface 240 by means of a suitably dimensioned O-ring 258. The cup-shaped contact seal 256 is secured onto the lower end of the piston 252 by means of a threaded sleeve 260 having a lower flange 262. The upper end of the piston 250 is provided with a transverse bore 264 having a hollow tubular wrist pin 266 secured therein by means of a force fit. The pair of stepped plug members 268 having an O-ring 270 disposed in the reduced diameter central portion thereof are secured in recesses in the upper end of the piston 250 at opposite ends of the wrist pin 266 by means of a force fit.

The piston 242 is connected to the crankshaft 210 by means of a hollow tubular piston rod 272 which is connected to the crank pin 224 by means of an offset connector 274 and an interposed bearing 276. In this way, the piston rod 272 for the pump unit 202 will be in substantial alignment with the piston rod for the pump unit 204 which in turn will be connected to the crank pin 222 by means of a similar offset connector 278 and interposed bearing 280. Such an arrangement will provide improved balancing of the assembly to reduce vibrations.

A short hollow tubular sleeve 282 is transversely secured to the upper end of the piston rod 272. The sleeve 282 may be integrally cast with the piston rod 272 or may be separately formed and secured thereto by any suitable means such as welding or the like, depending upon the materials involved. A bearing sleeve 284 is disposed between the sleeve 282 and the wrist pin 266 to provide a pivotal connection between the piston rod 272 and the wrist pin 266 which is fixedly connected to the upper end of the piston 250. A suitable recess 286 is provided in the upper end of the piston 250 to accommodate the pivotal connection. The hollow interior of the wrist pin 266 is disposed in communication with the hollow interior of the piston rod 272 as shown schematically by dashed lines 288.

Figure 13:
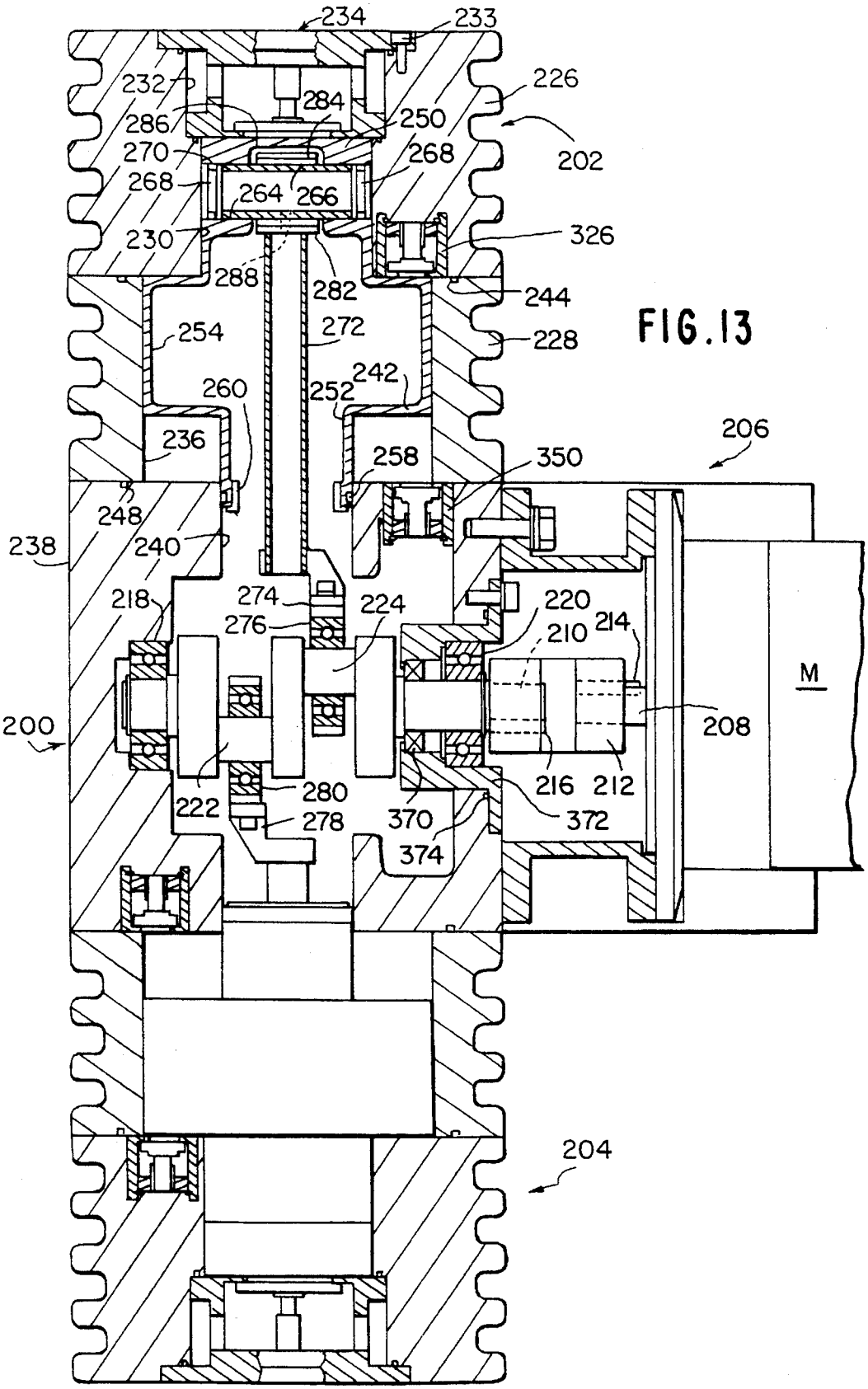
FIG. 13 is a sectional view of a further embodiment of the present invention with two pumping units connected to a common drive unit and incorporating cartridge valves.

The cartridge valve 234 acts as the outlet valve for stage one which is the same as stage one in the first embodiment. In the first embodiment, an electromagnetic valve 101 and a spring biased one-way valve 103 were provided in a valve plate 100 which defined stage one. In the present embodiment, the cartridge 234 replaces the valve plate, the cover plate and the two valves of the first embodiment. The cartridge valve 234 is fitted into the cylindrical bore 232 as shown in FIG. 13 and secured therein by means of a plurality of bolts 233, one of which is shown in FIG. 13. In order to show the details of the cartridge valve 234, reference is made to FIG. 18 which shows the cartridge valve in greater detail. The cartridge valve includes a hollow cylindrical portion 290 with a plurality of apertures 292 extending therethrough. An end plate 294 is integral with the cylindrical portion 290 and is provided with a bevelled valve seat 296. A mounting plate 298 is also integrally formed with the cylindrical portion 290 and is provided with laterally extending flanges having apertures for receiving the mounting bolts 233. A hollow cylindrical flange 300 extends downwardly from the center portion of the mounting plate 298 and the stem 302 of the valve 304 is slidably mounted in the sleeve 300 by means of splines 305. The valve 304 has the entire lower surface covered with a vinyl-rubber compound 306 and a plurality of projections or a circular protuberance 308 is provided on the lower surface thereof for engagement of the end of the piston 250 for opening the valve when the pressure in stage one is insufficient to overcome the force of the spring 310 which normally biases the valve 304 into engagement with the valve seat 296. A pair of O-rings 312 are provided for sealing the cartridge valve in the bore of the casting 226. Such a cartridge may be pre-assembled to facilitate the final assembly of the pump and to also facilitate a replacement of the valve at any time during the life of the pump.

As in the previous embodiment, each pump of the embodiment shown in FIG. 13 is provided with three stages in the exact same location as the three stages in the first embodiment. The inlet and outlet and the connections between the stages are substantially identical to those disclosed with respect to the first embodiment. The principle difference resides in the type of valve used to control the various stages. As indicated above, the cartridge valve 234 is used to control the outlet for the first stage. The inlet to the first stage is substantially identical to the inlet 54, 90 and 92 shown in FIG. 5 of the first embodiment. However, in lieu of the plurality of holes 92, a continuous slit (not shown) could be utilized since the use of a slit would be easier to manufacture than the holes 92. The inlet passage 312 shown in FIGS. 15, 16 and 17 which are sectional views of the second embodiment, is equivalent to the passage 54 shown in FIG. 5. The inlet passage 312 communicates with the circumferentially extending passage 314 which is equivalent to the passage 90 in FIG. 5.

Figure 15:
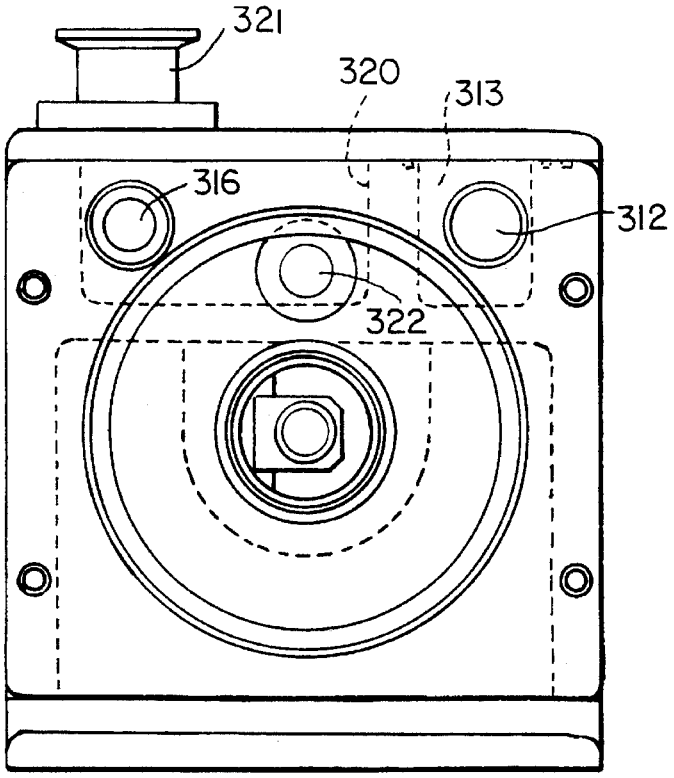
FIG. 15 is a sectional view taken along the line 15—15 of FIG. 13.
Figure 16:
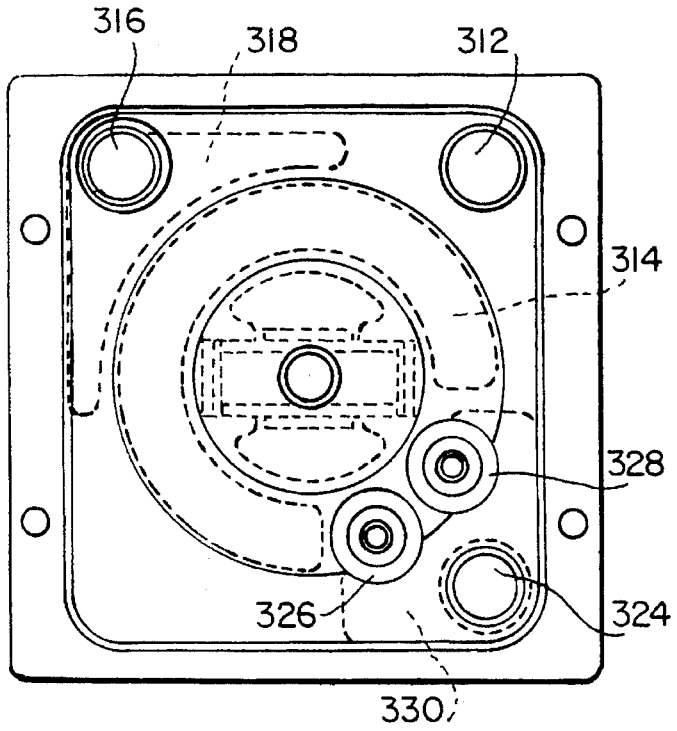
FIG. 16 is a sectional view taken along the line 16—16 of FIG. 13.
Figure 17:
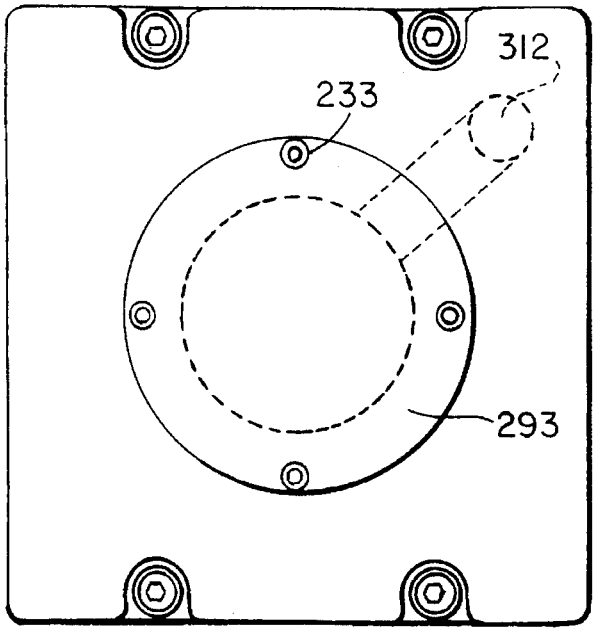
FIG. 17 is an end view taken along the line 17—17 in FIG. 13.
Figure 18:
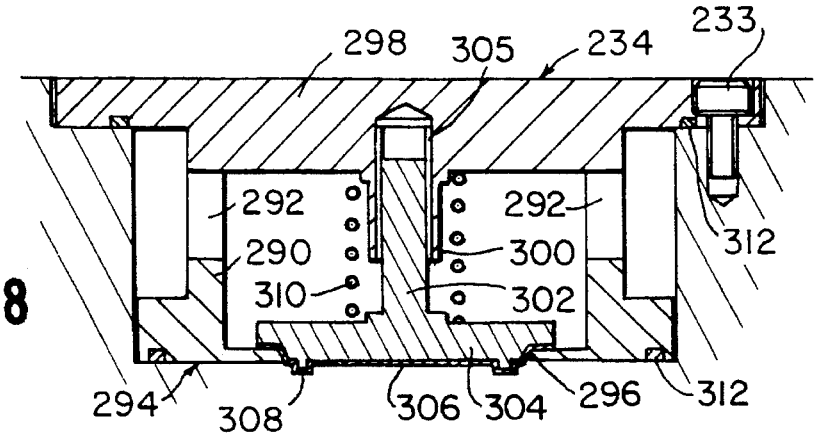
FIG. 18 is an enlarged sectional view of the first stage outlet valve cartridge.
Figure 19:
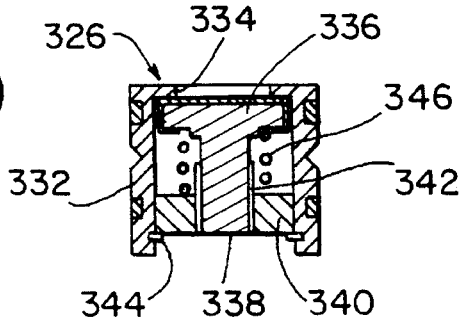
FIG. 19 is an enlarged sectional view of a valve cartridge as used in other locations.
Figure 20:
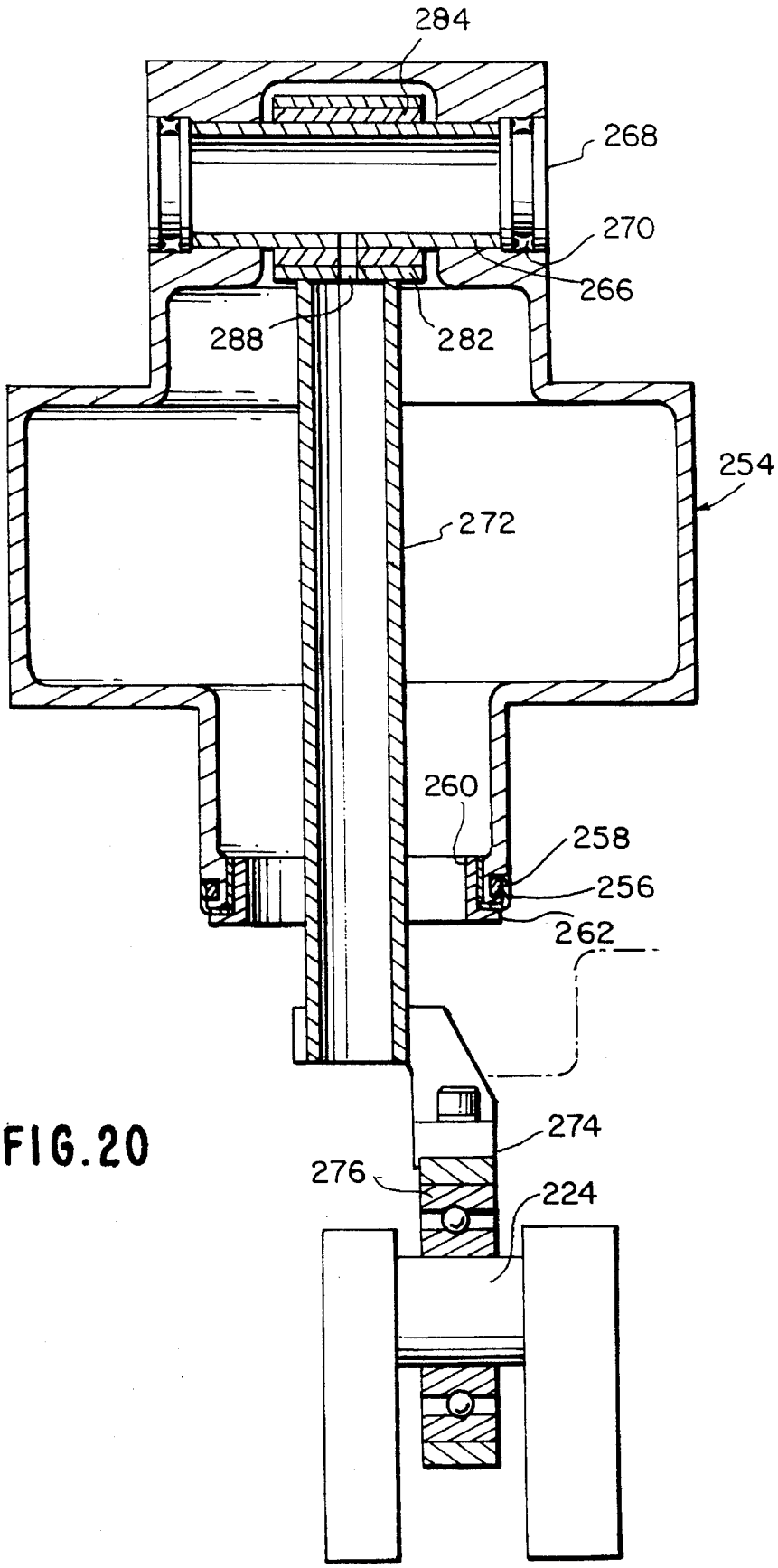
FIG. 20 is an enlarged sectional view of the piston assembly for a pump unit.

The passage 316 shown in FIGS. 15 and 16 constitutes the first stage exhaust which also communicates with the second stage inlet 318. The first stage exhaust passage 316 and the second stage inlet passage 318 are substantially identical to the first stage exhaust passage 58 and second stage inlet passage 59 of the first embodiment shown in FIG. 2 and FIG. 6 of the first embodiment. Once again the second stage inlet 318 will communicate with the second stage by means of a slit (not shown) or a plurality of apertures such as shown at 98 in FIG. 6. The first stage outlet passage 316 communicates with an outlet chamber 320 in the drive unit 200 which is similar to the outlet chamber 142 shown in FIG. 7 of the first embodiment. The passage 322 which constitutes the third stage exhaust also communicates with the exhaust chamber 320 as shown in FIG. 15.

The passage 324 shown in FIG. 16 is equivalent to the passage 56 which connects the second stage outlet to the third stage inlet as shown in FIG. 6 of the first embodiment. However, in the present embodiment, two identical exhaust valves 326 and 328 are provided for the second stage in lieu of the single valve 108 shown in FIG. 6 of the first embodiment. The two valves 326 and 328 communicate with the passage 324 through a chamber 330 equivalent to the passage 109 shown in FIG. 6. The opposite end of the passage 56 is connected to inlet holes or a slit in stage three equivalent to the holes 104 shown in stage three in FIG. 6 of the first embodiment. A passage having substantially the same configuration of the passage 330 but located in direct alignment therewith in FIG. 16, is provided for connecting the lower end of the passage 324 with the holes of the third stage. Such a passage would be equivalent and substantially identical to the passage 57 in the first embodiment. The new valves 326 and 328 are drop-in cartridge valves similar to the cartridge valves 234 shown in FIG. 18. However, the cartridge valve 326 is shown in detail in FIG. 19 and is comprised of a cylindrical body 332 having an end wall with an aperture 334 therein. The valve 336 is coated with a vinyl-rubber compound and the valve stem 338 is slidably connected to a closure plate 340 by means of a spline connector 342. The valve 336 and the end plate 340 may be inserted into the cylindrical housing 332 and a circlip 344 secures the assembly within the cylindrical housing. A coil spring 346 is provided between the valve 336 and the plate 340 to normally bias the valve 336 into engagement with a valve seat surrounding the aperture 334. One of the second stage exhaust valves 326 is shown in FIG. 13 whereby it is seen that the valves 326 and 328 can readily be dropped into apertures in the casting 326 prior to connecting the castings 226 and 228 together. The third stage exhaust valve 350 shown in FIG. 13 is also a drop-in cartridge type valve similar to the valves 326 and 328 and can readily be dropped into a suitable aperture in the casting 238 of the drive unit prior to connection of the pump unit 202 to the drive unit 200. A valve substantially identical to the valve 350 is also provided at the end of the first stage exhaust passage 316 where it enters into the exhaust chamber 320 in the drive unit. The exhaust chamber 320 is provided with an outlet fitting 321 shown in FIG. 15 which may be connected to any suitable type of container for collecting the exhaust gasses from the first and third stages in the event toxic elements might be included in the exhaust gasses.

The inlet passage 312 as shown in FIG. 15 communicates with an inlet chamber 313 formed in the housing 238 of the drive unit 200. This inlet chamber 313 is equivalent to the inlet chamber 140 shown in FIG. 7 of the first embodiment. An inlet fitting 323 identical to the outlet fitting 322 is provided on the housing 238 and communicates with the inlet chamber 313 in a manner not shown in the drawings. The inlet fitting is adapted to be connected to whatever vessel is to be evacuated.

Figure 14:
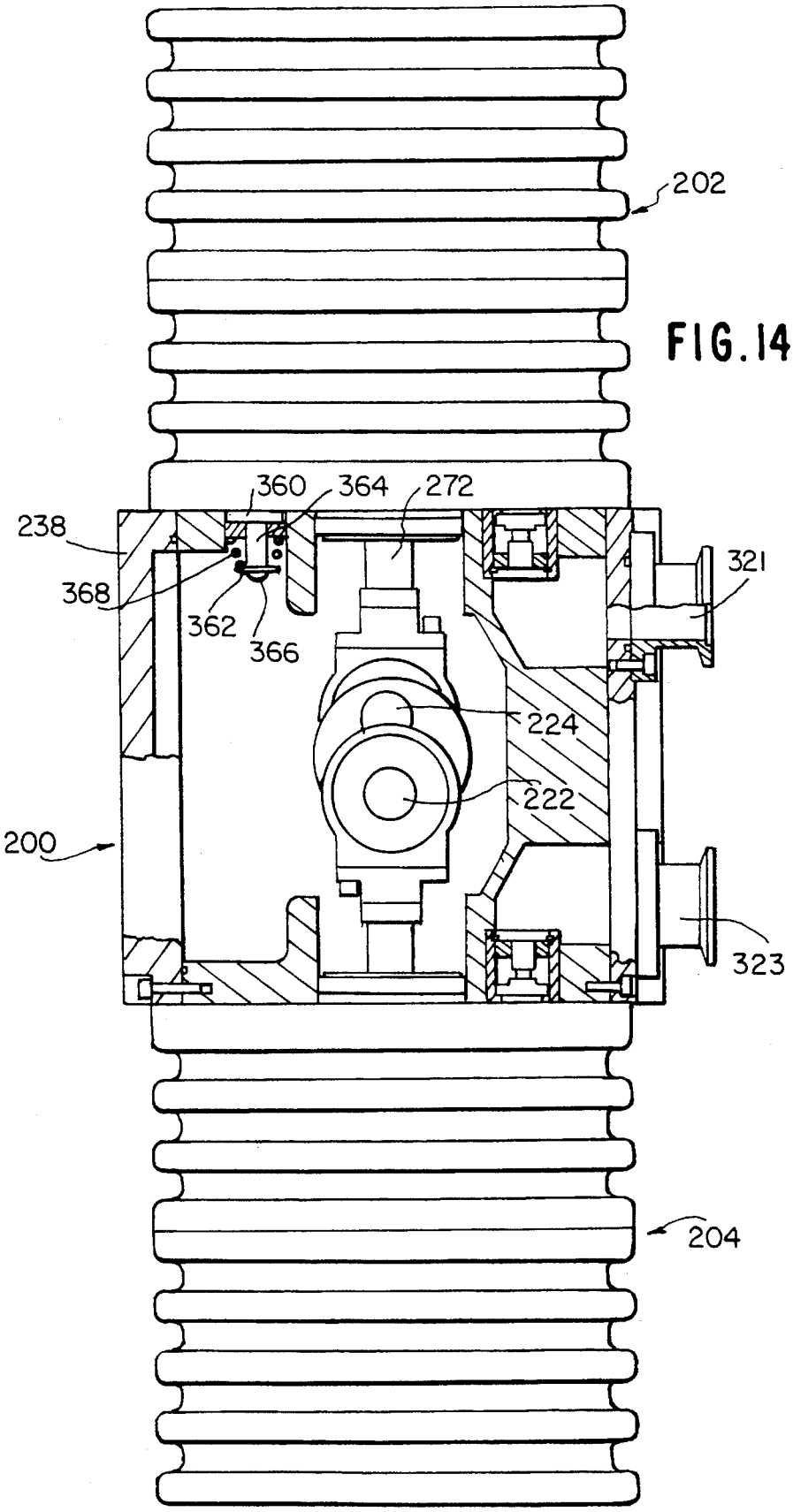
FIG. 14 is an end view of the assembly shown in FIG. 13 as viewed from the left with a portion of the drive unit housing removed.

The third stage of the pump unit 202 is connected to the interior of the housing 238 of the drive unit 200 by means of a one way valve 360 which is normally spring biased into the closed position as shown in FIG. 14. A plate 362 is secured to the end of the valve stem 364 by means of a screw 366 and a spring 368 extending between the housing 238 and the plate 362 biases the valve 360 into engagement with the seat formed on the housing 238. The valve 360 is equivalent to the valve 114 disclosed in FIG. 4 of the first embodiment and is provided to permit gas to enter stage three to lower the pressure in the drive unit to about 1/10 of an atmosphere. It is important to make sure that the pressure in the drive unit is not so low as to prevent heat transfer from the internal mechanism of the drive unit and the pumping unit via the gas to the walls or surfaces of the housing which are of aluminum. The housing 238 of the drive unit 200 is maintained in a sealed condition by the seal 370 between the bearing support 372 and the crankshaft 210 and an O-ring 374 between the housing 238 and the bearing support 372 as shown in FIG. 13. The interior of the casing 238 is in communication with the interior of the piston 254. The cup-shaped seal 256 seals the lower end of the piston 254 to the wall 240 of the cylinder and the upper end of the piston is sealed by the sealing rings 270 at the opposite ends of the wrist pin 266. Any gasses which might leak into the interior of the cylinder or the interior of the drive unit housing 238 might raise the pressure but the pressure will be immediately reduced by the provision of the one way valve 360 and the pumping action of the pump. Thus if the gasses leaking into the interior of the piston 254 or the housing 238 contain any toxic substances, the substances will be expelled through the valve 360 into the third stage and from the third stage to the collecting vessel through the third stage exhaust valve 350 and the exhaust fitting 321.

In addition to interconnecting the various stages of each pump in series, parallel or a combination thereof as described above with respect to FIGS. 10–12 inclusive, the two pumps may be connected for operation in series or in parallel with each other. As shown in FIG. 7 with respect to the first embodiment the inlet chamber 140 in the drive unit 12 extends in a zigzag fashion from one corner of the unit to another so that if a second pumping unit was connected, the inlet for each pumping unit would be in communication with a common inlet chamber 140 in the drive unit 12. Two separate exhaust chambers 142 and 144 are shown in FIG. 7 so that with that arrangement of chambers, the two pumps would operate in parallel with each other. In a similar manner, the inlet chamber 313 for each pumping unit as shown in FIG. 15 would be interconnected so that two pumping units 202 and 204 would operate in parallel.

In order to operate the pump units 202 and 204 in series with each other it would only be necessary to interconnect the exhaust chamber 320 as shown in FIG. 15 to the inlet chamber corresponding to inlet chamber 313 but associated with the inlet chamber for the other pump unit. Thus the exhaust chamber of one pump unit would be connected to the inlet chamber of the other pump unit thereby connecting the two pump units in series. When two pumping units are combined on a single drive unit and are operated in series as described above, an ultimate pressure of well below 20 mTORR with result while still maintaining a pumping speed of 100 l/min.

When two pumping units are connected in parallel as described above, it is possible to produce a pump with 200 l/min pumping speed though a higher ultimate pressure will result. The changes between a series connection and a parallel connection must be carried out at the factories since changes would have to be made to the machine castings forming the drive unit 200.

While the invention has been particularly shown and described with reference to preferred embodiments thereof, it will be understood by those in the art that the foregoing and other changes in form and details may be made therein without departing from the spirit and scope of the invention.

What is claimed is:

1. A multi-stage vacuum pump comprising housing means, a cylinder disposed in said housing means having opposite end portions of substantially equal diameter and an enlarged diameter central portion, a piston with a substantially hollow interior disposed in said cylinder having a closed end and an end open to said interior cylindrical end portions adjacent each end having substantially equal diameters and an enlarged diameter intermediate portion, first exhaust valve means disposed in said cylinder adjacent said closed end of said piston to define a first stage pumping chamber between said valve means and said closed end of said piston, said large diameter portion of said piston having an axial extent less than an axial extent of said enlarged diameter portion of said cylinder and defining an annular second stage pumping chamber and an annular third stage pumping chamber on opposite sides of said enlarged diameter portion of said piston, inlet and outlet means disposed in said housing means and passage means interconnecting said inlet and outlet means with said pumping chambers, second and third exhaust valve means disposed in said passage means adjacent said second and third stage pumping chambers and drive means operatively connected to said piston for reciprocating said piston in said cylinder.

2. A multi-stage vacuum pump as set forth in claim 1, wherein said housing means is of cast aluminum with said passage means and said cylinder being integrally formed therein.

3. A multi-stage vacuum pump as set forth in claim 1, wherein said passage means includes a first passage constituting an inlet passage disposed in communication with said inlet means and said first stage pumping chamber;

a second passage disposed in communication with said first exhaust valve means, an exhaust valve in said outlet means and said second stage pumping chamber; and a third passage in communication with said second exhaust valve means and said third stage pumping chamber.

4. A multi-stage vacuum pump as set forth in claim 3, further comprising first inlet port means disposed in said cylinder in communication with said first stage pumping chamber when said piston is disposed in a bottom dead center position, second inlet port means disposed in communication with said second stage pumping chamber and said second passage when said piston is disposed in said bottom dead center position and third inlet port means disposed in communication with said third stage pumping chamber and said third passage when said piston is in an upper dead center position.

5. A multi-stage vacuum pump as set forth in claim 1, wherein said housing means is comprised of a pump housing and a drive housing, said drive housing having a first end wall secured to said pump housing, said first end wall having an open cylindrical portion extending into said drive housing, in which said open end of said piston reciprocates, a crankshaft rotatably mounted in said drive housing with one end thereof extending outwardly of the drive housing through a hermetic seal, connecting means connecting said crankshaft to said piston and motor means mounted on said drive housing externally thereof and connected to said crankshaft for rotating said crankshaft.

6. A multi-stage vacuum pump as set forth in claim 5, wherein said drive housing has a hollow interior, partition means dividing said interior into four hermetically separated chambers including a first chamber in which said crankshaft, connecting means and open end of said piston operate with sealing means between said open end of said piston and said cylindrical portion of said drive housing, a second chamber having an inlet adapted to be connected to a chamber to be evacuated and an opening in said first end wall in communication with said inlet means of said pump housing and third and fourth chambers having a common exhaust and provided with first and second ports, said first port being disposed in alignment with said second passage in said pump housing and said second port having a one-way valve therein disposed in communication with said third stage pumping chamber.

7. A multistage vacuum pump as set forth in claim 1, wherein said first exhaust valve means is comprised of a cartridge having a substantially hollow cylindrical sleeve having first and second end walls and aperture means extending through said sleeve, an opening defining a valve seat formed in one end wall, a valve mounted for sliding reciprocating movement on said second end wall and spring means disposed between said second end wall and said valve for normally biasing said valve into engagement with said valve seat, said cartridge being disposed in a complementary cylindrical recess formed in said cylinder adjacent said closed end of said piston.

8. A multistage vacuum pump as set forth in claim 1, wherein each of said second and third exhaust valve means is comprised of a cartridge-type valve having a hollow cylindrical sleeve in one end wall with an opening defining a valve seat, a valve member movably mounted within said sleeve and having a valve stem slidably mounted in a spring abutment plate with spring means disposed between said spring abutment plate and said valve and means secured to said sleeve for retaining said spring abutment plate and said valve within said sleeve.

* * * * *